US006843425B2

(12) United States Patent
Lee

(10) Patent No.: US 6,843,425 B2
(45) Date of Patent: Jan. 18, 2005

(54) AIR CONDITIONER AND METHOD FOR CONTROLLING THE SAME

(75) Inventor: Won Hee Lee, Seoul-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/397,224

(22) Filed: Mar. 27, 2003

(65) Prior Publication Data

US 2004/0098993 A1 May 27, 2004

(30) Foreign Application Priority Data

Nov. 22, 2002 (KR) ..... 10-2002-0073106

(51) Int. Cl.[7] ..... G05D 23/00
(52) U.S. Cl. ..... 237/2 A; 237/2 B; 62/238.1
(58) Field of Search ..... 237/2 A, 2 B; 62/238.7, 238.6, 238.5, 238.4, 238.3, 238.2, 238.1

(56) References Cited

U.S. PATENT DOCUMENTS 4,323,109 A * 4/1982 Jaster ..... 165/45
4,627,483 A * 12/1986 Harshbarger et al. ..... 237/2 A
5,367,601 A * 11/1994 Hannabery ..... 392/307
5,465,588 A * 11/1995 McCahill et al. ..... 62/127
5,752,654 A * 5/1998 Mowery et al. ..... 237/2 B

* cited by examiner

*Primary Examiner*—Derek S. Boles
(74) *Attorney, Agent, or Firm*—Greenblum & Bernstein, P.L.C.

(57) ABSTRACT

Disclosed are an apparatus and a method for controlling compressors of an air conditioner. The apparatus includes a temperature sensor, a comparison unit, and a controller. The temperature sensor is installed close to an outdoor unit and serves to sense an outdoor temperature. The comparison unit compares the outdoor temperature sensed by the temperature sensor to a predetermined temperature. The controller determines a heating load when the comparison unit determines that the outdoor temperature is more than the predetermined temperature, and controls the operation of the plural compressors based on the determined heating load. The apparatus determines the heating load by means of the outdoor temperature, and properly operates the plural compressors depending the determined heating load, thereby improving the heating efficiency of the air conditioner.

11 Claims, 4 Drawing Sheets

AIR CONDITIONER AND METHOD FOR CONTROLLING THE SAME

BACKGROUND OF THE INVENTION

1. Field of the Invention

The present invention relates to an air conditioner in which a heating load is determined in consideration of a heat loss at the outside or a room when an outdoor temperature is low and a plurality of compressors are efficiently operated depending on the obtained result of the determined heating load, and a method for controlling the air conditioner.

2. Description of the Related Art

Generally, an air conditioner is an appliance for cooling or heating a room. The air conditioner comprises a compressor, a condenser, an expansion device, an evaporator, and a refrigerant pipe. The compressor serves to compress a refrigerant into a high-temperature and high-pressure gaseous state. The condenser serves to condense the refrigerant passing through the compressor into a high-temperature and high-pressure liquid state. The expansion device serves to decompress the refrigerant passing through the condenser into a low-temperature and low-pressure liquid state. The evaporator serves to evaporate the refrigerant passing through the expansion device into a low-temperature and low-pressure gaseous state. The compressor, the condenser, the expansion device, and the evaporator are connected by the refrigerant pipe.

A heat pump-type air conditioner further comprises a direction change valve, such as a 3-way valve or a 4-way valve, adapted to change the flow direction of the refrigerant based on a cooling/heating function, thereby being selectively operated in a cooling or heating mode.

In the cooling mode of the air conditioner, an outdoor heat exchanger serves as the condenser, and an indoor heat exchanger serves as the evaporator. On the other hand, in the heating mode of the air conditioner, the outdoor heat exchanger serves as the evaporator, and the indoor heat exchanger serves as the condenser.

In the cooling mode, the air conditioner allows indoor air to pass through the indoor heat exchanger serving as the evaporator, thereby discharging cold air to the room. In the heating mode, the air conditioner allows indoor air to pass through the indoor heat exchanger serving as the condenser, thereby discharging warm air to the room.

Recent air conditioners have employed a plurality of compressors having different capacities so that the plural compressors are simultaneously or selectively operated in accordance with cooling or heating loads. Accordingly, it is possible to properly cope with the variation of the cooling or heating load, thereby optimizing the cooling or heating efficiency of the air conditioner.

In the heating mode of the air conditioner, a user sets a desirable target temperature and subsequently operates the air conditioner. Here, a heating load is determined by the difference between the target temperature and a current room temperature, and the air conditioner allows all of the plural compressors to be simultaneously operated or parts of the plural compressors to be selectively operated according to the determined heating load.

When the compressors are operated, the compressors compress a refrigerant into a high-temperature and high-pressure gaseous state. Then, the indoor heat exchanger serving as the condenser heat-exchanges the refrigerant passing through the compressors with indoor air, thereby condensing the refrigerant into a high-temperature and high-pressure liquid state and warming the indoor air. The expansion device expands the refrigerant passing through the indoor heat exchanger into a low-temperature and low-pressure liquid state. The outdoor heat exchanger serving as the evaporator heat-exchanges the refrigerant passing through the expansion device with outdoor air, thereby evaporating the refrigerant into a low-temperature and low-pressure gaseous state.

In the winter season when the outdoor temperature is low, the outdoor temperature is equal to that of the refrigerant passing through the outdoor heat exchanger or lower than that of the refrigerant passing through the outdoor heat exchanger. Accordingly, heat cannot be transferred from the outdoor air to the refrigerant of the outdoor heat exchanger. On the contrary, heat is transferred from the refrigerant of the outdoor heat exchanger to the outdoor air.

Thus, the temperature of the refrigerant of the outdoor heat exchanger is lowered by the above heat transfer from the refrigerant to the outdoor air, and the lowered refrigerant circulates through the air conditioner, thereby reducing the heating efficiency of the air conditioner.

Further, based on the load determined by the difference between the room temperature and the target temperature, all of the plural compressors are simultaneously operated or a part of the plural compressors are selectively operated. Accordingly, although the outdoor temperature is low, when it is determined that the heating load is small, only the part of the compressors are operated, thereby causing difficulty in satisfactorily maintaining the room temperature.

SUMMARY OF THE INVENTION

Therefore, the present invention has been made in view of the above problems, and it is an object of the present invention to provide an air conditioner, which correctly determines in a heating mode whether a plurality of compressors are simultaneously or selectively operated by means of an outdoor temperature as well as a heating load, and a method for controlling the air conditioner, thereby improving the heating efficiency of the air conditioner.

In accordance with one aspect of the present invention, the above and other objects can be accomplished by the provision of an air conditioner comprising: a plurality of compressors for compressing a refrigerant; an outdoor heat exchanger installed outdoors so as to be connected to the compressors for heat-exchanging the refrigerant with outdoor air; an indoor heat exchanger installed indoors so as to be connected to the outdoor heat exchanger for heat-exchanging the refrigerant with indoor air; a temperature sensor installed outdoors close to the outdoor heat exchanger for sensing an outdoor temperature (T); a comparison unit for comparing the outdoor temperature (T) sensed by the temperature sensor to a predetermined temperature ($T_1$); and a controller for determining a heating load when the comparison unit determines that the outdoor temperature (T) is more than the predetermined temperature ($T_1$), and operating all of the plural compressors or a part of the plural compressors based on the determined heating load.

Preferably, the comparison unit may include a memory unit for storing the predetermined temperature ($T_1$).

Further, preferably, the predetermined temperature ($T_1$) may be in the range of 5° C. to 9° C. where heat is transferred from the refrigerant of the outdoor heat exchanger to outdoor air so as to effect a heat loss.

Moreover, preferably, the controller may determine the heating load by means of the difference between a room temperature and a desirable target temperature.

Preferably, the controller may operate all of the plural compressors when the heating load is larger than a predetermined value, or operate the part of the plural compressors when the heating load is smaller than a predetermined value.

Further, preferably, the controller may operate all of the plural compressors when the comparison unit determines that the outdoor temperature (T) is not more than the predetermined temperature ($T_1$).

Moreover, preferably, the compressors may include two compressors having different capacities, and the controller may operate one compressor having the relatively smaller capacity of the two compressors when the heating load is smaller than a predetermined value.

In accordance with another aspect of the present invention, there is provided a method for controlling an air conditioner, comprising the steps of: (a) sensing an outdoor temperature (T) of the outdoors where an outdoor heat exchanger is installed in a heating mode; (b) comparing the outdoor temperature (T) sensed at the step (a) to a predetermined temperature ($T_1$); (c) determining a heating load when it is determined at the step (b) that the outdoor temperature (T) is more than the predetermined temperature ($T_1$); and (d) controlling a plurality of compressors of the air conditioner so that all of the compressors are operated or a part of the compressors are operated based on the determined heating load at the step (c).

Preferably, the method may further comprise the step of operating all of the plural compressors for a designated time at an initial stage of the heating mode.

Further, preferably, the predetermined temperature ($T_1$) at the step (b) may be in the range of 5° C. to 9° C. where heat is transferred from a refrigerant of the outdoor heat exchanger to the outdoor air.

Moreover, preferably, all of the plural compressors may be operated when it is determined at the step (b) that the outdoor temperature (T) is not more than the predetermined temperature ($T_1$).

Preferably, the step of (c) may include the step of (c-1) determining the heating load by comparing the difference between a room temperature and a desirable target temperature to a predetermined value.

Further, preferably, all of the plural compressors may be operated when it is determined at the step (c) that the difference between the room temperature and the desirable target temperature is larger than the predetermined value, or a part of the plural compressors may be operated when it is determined at the step (c) that the difference between the room temperature and the desirable target temperature is smaller than the predetermined value.

Moreover, preferably, the plural compressors may include two compressors having difference capacities, and one compressor having the relatively larger capacity of the two compressors may be operated when it is determined at the step (c) that the difference between the room temperature and the desirable target temperature is smaller than the predetermined value.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
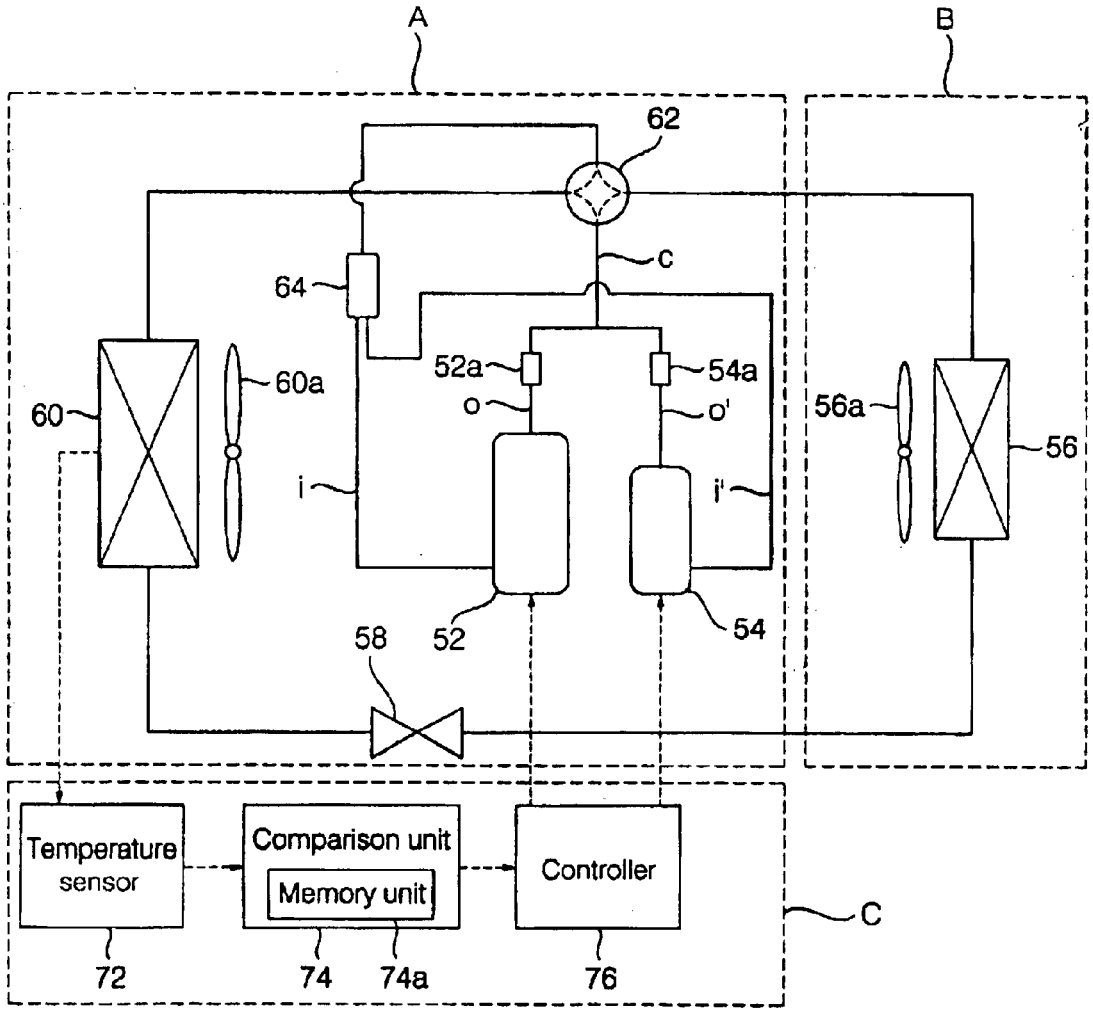
FIG. 1 is a schematic view of an air conditioner in accordance with the present invention.

As shown in FIG. 1, an air conditioner in accordance with the present invention comprises an outdoor unit A and an indoor unit B which are connected to each other via a refrigerant pipe, and a control apparatus C for controlling the operations of a plurality of compressors of the outdoor unit A.

The outdoor unit A includes first and second compressors 52 and 54, an expansion device 58 such as a capillary tube or an electronic expansion valve, an outdoor heat exchanger 60, an outdoor fan 60*a*, a direction change valve 62 for changing the flow direction of a refrigerant, an oil separating means 64, and a refrigerant pipe, for connecting such components, provided with a plurality of check valves 52*a* and 54*a*. The indoor unit B includes an indoor heat exchanger 56 and an indoor fan 56*a*.

More specifically, outlet pipes o and o' are connected to rear ends of the first and second compressors 52 and 54, respectively. In order to prevent the backflow of the refrigerant into the first and second compressors 52 and 54, the first and second check valves 52*a* and 54*a* are installed in the outlet pipes o and o'. A connection pipe c is connected to the outlet pipes o and o' so that the refrigerants from the two outlet pipes o and o' are joined together and guided to the indoor heat exchanger 56 or the outdoor heat exchanger 60 to circulate through the air conditioner according to a cooling or heating mode.

Inlet pipes i and i' are branched from the end of the connection pipe c, and connected to the first and second compressors 52 and 54 so as to guide the refrigerant to the first and second compressors 52 and 54. The oil separating means 14 is positioned between the connection pipe c and the inlet pipes i and i', and serves to separate oils discharged together with the refrigerants from the first and second compressors 52 and 54, and to supply the separated oils to the first and second compressors 52 and 54.

Here, the direction change valve 62 for selectively controlling the flow direction of the refrigerant is installed in the connection pipe c connected to the rear ends of the first and second check valves 52*a* and 54*a*. The direction change valve 62 allows the refrigerants compressed by the first and second compressors 52 and 54 to flow toward the outdoor heat exchanger 60, thereby forming a cooling cycle, or to flow toward the indoor heat exchanger 56, thereby forming a heating cycle.

The first compressor 52 has a refrigerant compression capacity of (100−X) %, and the second compressor 54 has a refrigerant compression capacity of X %. Accordingly, the first and second compressors 52 and 54 are simultaneously or selectively operated according to cooling or heating loads to be eliminated.

The outdoor fan 60*a* is installed adjacent to the outdoor heat exchanger 60, and the indoor fan 56*a* is installed adjacent to the indoor heat exchanger 56. Accordingly, the outdoor fan 60*a* and the indoor fan 56*a* are rotated at different speeds based on a variation in the cooling or heating load, thereby controlling the amount of blowing outdoor air and indoor air, respectively.

The control apparatus C includes a temperature sensor 72, a comparison unit 74, and a controller 76. The temperature sensor 72 is positioned close to the outdoor heat exchanger 60 and serves to sense an outdoor temperature (T). The comparison unit 74 serves to compare the outdoor temperature (T) sensed by the temperature sensor 72 to a predetermined temperature ($T_1$) The controller 76 determines the cooling or heating load when the comparison unit 74 determines that the outdoor temperature (T) is more than the predetermined temperature ($T_1$), and controls the operations of the first and second compressors 52 and 54 according to the determined cooling or heating load.

When the above air conditioner is operated in the heating mode, the control apparatus C determines the heating load in consideration of the outdoor temperature, thereby controlling the operations of the first and second compressors 52 and 54.

Here, the temperature sensor 72 is installed in a refrigerant pipe located close to the outdoor heat exchanger 60 or installed adjacent to a case of the outdoor unit A, and measures the temperature of the outdoor air blown toward the outdoor heat exchanger 60.

The comparison unit 74 includes a memory unit 74*a* in which the predetermined temperature ($T_1$) is stored in advance. The predetermined temperature ($T_1$) is in the range of 5° C. to 9° C. where heat is transferred from the refrigerant of the outdoor heat exchanger 60 to the outdoor air so as to effect a heat loss.

When the comparison unit 74 determines that the outdoor temperature (T) is more than the predetermined temperature ($T_1$), the controller 76 determines a heating load. The heating load is determined by the difference between an indoor temperature (t) and a desirable target temperature ($t_0$) inputted by a user. Then, the controller 76 compares the determined heating load to a predetermined value, thereby controlling the operations of the first and second compressors 52 and 54.

When the determined heating load is not more than the predetermined value, the controller 76 operates either one of the first and second compressors 52 and 54. Here, the controller 76 operates the first compressor 52 having the relatively larger refrigerant compression capacity. Otherwise, when the determined heating load is more than the predetermined value, the controller 76 operates both the first and second compressors 52 and 54.

On the other hand, when the comparison unit 74 determines that the outdoor temperature (T) is not more than the predetermined temperature ($T_1$), the controller 76 operates both the first and second compressors 52 and 54 regardless of the heating load.

When the outdoor temperature (T) is not more than the predetermined temperature ($T_1$), heat is transferred from the refrigerant of the outdoor heat exchanger 60 to the outdoor air, thus effecting the heat loss. Then, the temperature of the refrigerant passing through the outdoor heat exchanger 60 is lowered, and the lowered refrigerant circulates through the heating cycle of the air conditioner. Thereby, the heating efficiency of the air conditioner is degraded. The operations of both first and second compressors 52 and 54 prevent the above degradation of the heating efficiency of the air conditioner.

Figure 2:
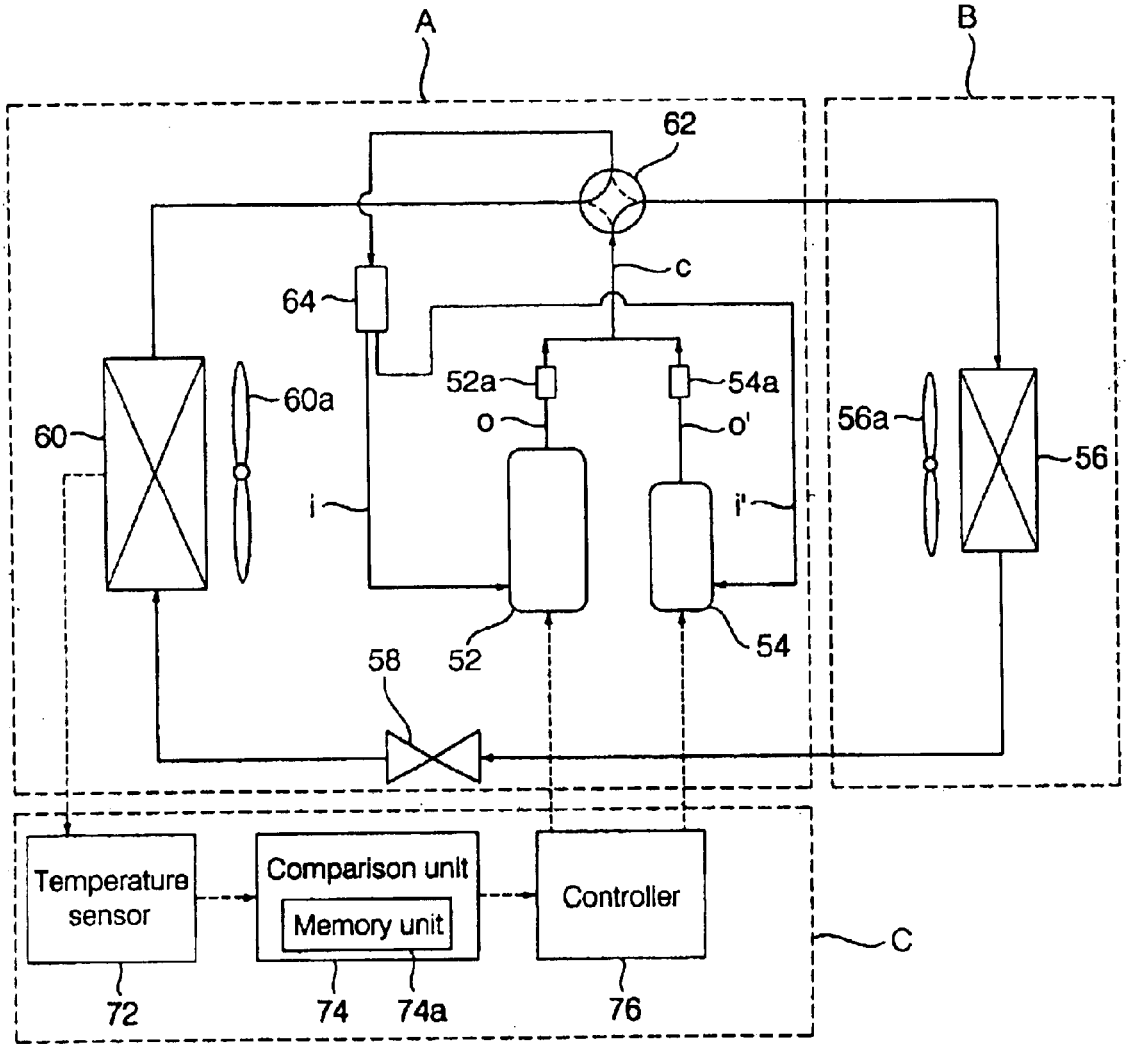
FIG. 2 is a schematic view illustrating the flow of a refrigerant in a heating mode of the air conditioner in accordance with the present invention when a heating load is large.

With reference to FIG. 2, the operation of only the first compressor 52 by means of the control apparatus C of the present invention is described, as follows. When the first compressor 52 is operated, the refrigerant is compressed by the first compressor 52 into a high-temperature and high-pressure gaseous state, flows along the outlet pipe o of the first compressor 52 and the connection pipe c, and is introduced into the indoor heat exchanger 56 serving as the condenser. Then, the indoor heat exchanger 56 condenses the refrigerant into a high-temperature and high-pressure liquid state.

When the indoor fan 56*a* is operated, the indoor air blown into the indoor heat exchanger 56 is heat-exchanged with the refrigerant of the indoor heat exchanger 56, thereby being warmed and then discharged into a room to heat the room.

The expansion device 58 expands the refrigerant passing through the indoor heat exchanger 56 into a low-temperature and low-pressure liquid state. Then, the outdoor heat exchanger 60 evaporates the refrigerant passing through the expansion device 58 to a low-temperature and low-pressure gaseous state. That is, when the outdoor fan 60*a* is operated, the refrigerant is heat-exchanged with the outdoor air blown into the outdoor heat exchanger 60 and evaporated into the low-temperature and low-pressure gaseous state. Next, the refrigerant passes through the oil separating means 64 and is returned to the first compressor 52 along the inlet pipe i connected to the first compressor 52. As described above, the refrigerant compressed by the first compressor 52 circulates through the air conditioner, thereby allowing the air conditioner to be operated in the heating mode.

Figure 3:
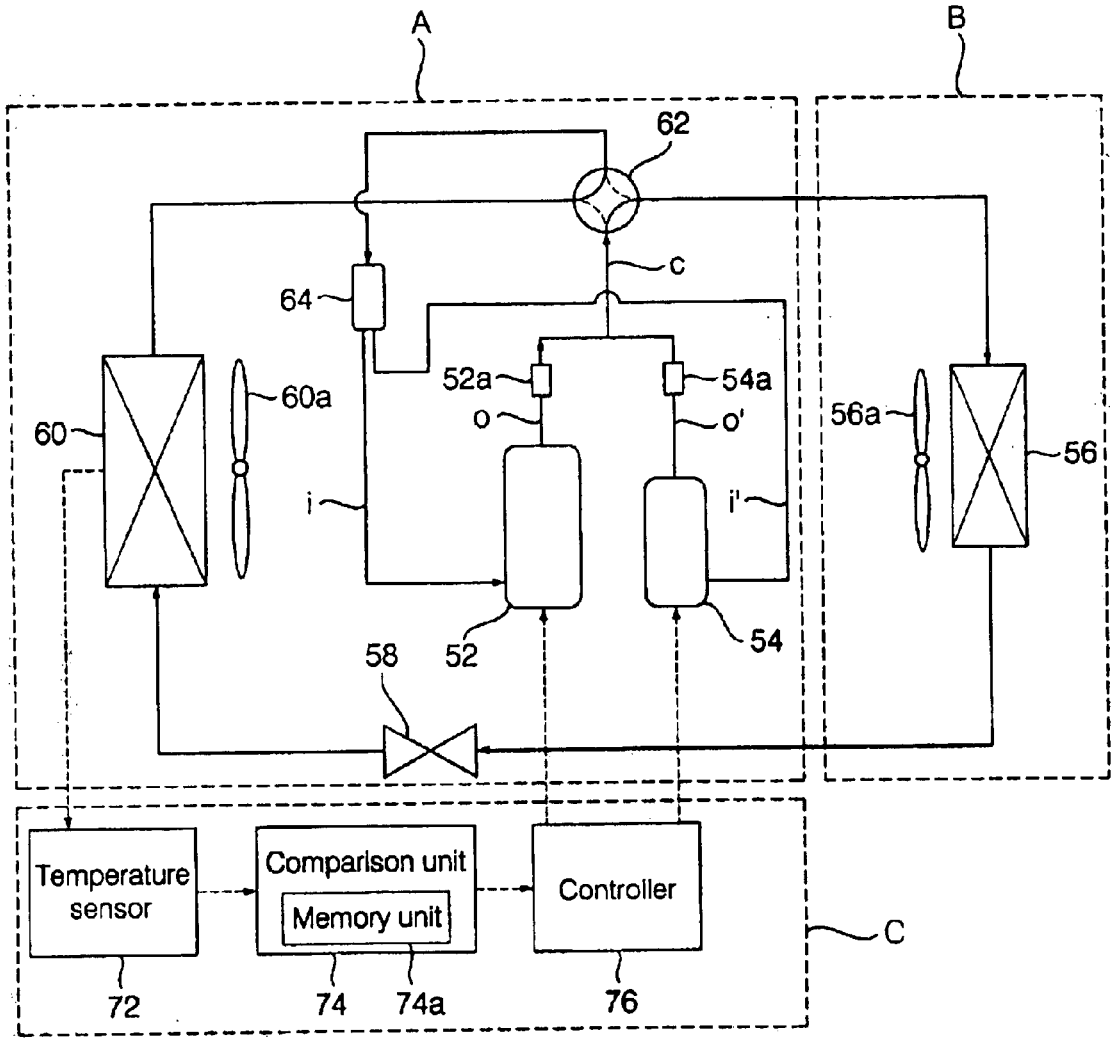
FIG. 3 is a schematic view illustrating the flow of the refrigerant in the heating mode of the air conditioner in accordance with the present invention when the heating load is small.

On the other hand, with reference to FIG. 3, the operations of both the first and second compressors 52 and 54 by means of the control apparatus C of the present invention are described, as follows. The refrigerant circulates through the first and second compressors 52 and 54, the outlet pipes o and o', the indoor heat exchanger 56, the expansion device 58, the outdoor heat exchanger 60, the oil separating means 64, and the inlet pipes i and i', thereby allowing the air conditioner to be operated in the heating mode.

Figure 4:
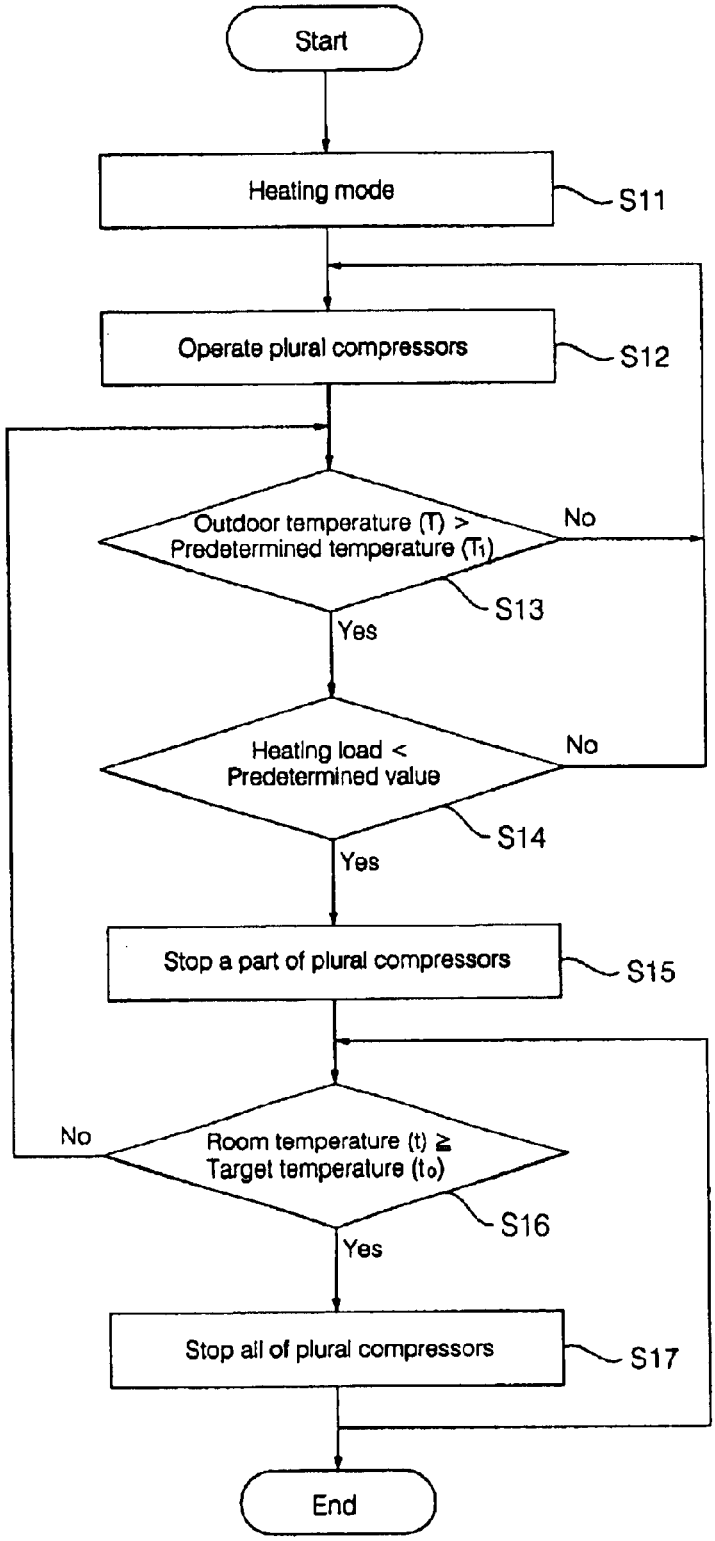
FIG. 4 is a flow chart illustrating a method for controlling compressors of the air conditioner in accordance with the present invention.

Hereinafter, with reference to FIG. 4, a method for controlling the air conditioner of the present invention is described.

First, a heating mode is selected and a desirable target temperature ($t_0$) is set by a user (S11). A heating load is determined by the difference between the target temperature ($t_0$) and a current room temperature (t), and simultaneously the first and second compressors 52 and 54 are operated for a designated time (S12).

Generally, a heating load at an initial stage of the heating mode is relatively larger. Therefore, the first and second compressors 52 and 54 are simultaneously operated for the designated time so as to increase the room temperature (t) to the target temperature ($t_0$) for a short period of time.

The operations of both the first and second compressors 52 and 54 rapidly raise the room temperature (t), thereby rapidly and effectively heating the user's room.

During the operations of the first and second compressors 52 and 54 at step S12, an outdoor temperature (T) is compared to a predetermined temperature ($T_1$) (S13).

Here, the outdoor temperature (T) denotes the temperature of outdoor air sensed by the temperature sensor 72 located close to the outdoor unit A. The predetermined temperature ($T_1$) is set in the range of 5° C. to 9° C. where heat is transferred from the refrigerant of the outdoor heat exchanger 60 to the outdoor air, thereby effecting the heat loss. The predetermined temperature ($T_1$) is stored in the memory unit 74*a* of the comparison unit 74.

When it is determined at step S13 that the outdoor temperature (T) is more than the predetermined temperature ($T_1$), the heating load to be eliminated is compared to a predetermined value (S14).

The heating load is determined by the difference between the indoor temperature (t) and the target temperature ($t_0$), and other factors such as the rate of the variation in the room temperature (t) by means of the operations of the first and second compressors 52 and 54. The determined heating load is compared to the predetermined value which is already stored in the memory unit 74.

When it is determined at step S14 that the outdoor temperature (T) is not more than the predetermined temperature ($T_1$), the first and second compressors 52 and 54 are continued to be operated.

In this case, although the room temperature (t) is increased by the operations of the first and second compressors 52 and 54 and thus the heating load determined by the difference between the indoor temperature (t) and the target temperature ($t_0$) is reduced, heat is transferred from the refrigerant of the outdoor heat exchanger 60 to the outdoor air, thereby effecting the heat loss. Then, the temperature of the refrigerant circulating through the heating cycle of the air conditioner is decreased, thus degrading the heating efficiency of the air conditioner. In order to prevent such a degradation of the heating efficiency of the air conditioner, the first and second compressors 52 and 54 maintain their operation.

When it is determined at step S14 that the heating load is not more than the predetermined value, one of the first and second compressors 52 and 54 is stopped and the other is continued to be operated (S15).

Since the heating load is eliminated only by the operation of one of the first and second compressors 52 and 54, the simultaneous operations of the first and second compressors 52 and 54 are prevented so as to improve the heating efficiency of the air conditioner and reduce the power consumption.

However, when it is determined at step S14 that the heating load is more than the predetermined value, the first and second compressors 52 and 54 are continued to be operated.

It is determined whether the room temperature (t) reaches the target temperature ($t_0$) by the operation of one of the first and second compressors 52 and 54 at step S15 (S16). When the room temperature (t) reaches the target temperature ($t_0$), the operation of one of the first and second compressors 52 and 54 is stopped (S17).

However, when the room temperature (t) does not reach the target temperature ($t_0$), the outdoor temperature (T) is again compared to the predetermined temperature ($T_1$), thereby determining the heating load.

The apparatus and the method for controlling the compressors of the air conditioner in accordance with the present invention have several advantages, as follows.

First, since the heating load is determined by the outdoor temperature (T) and the operations of the plural compressors are controlled by the determined heating load, the temperature of the refrigerant circulating through the air conditioner operated in the heating mode is increased and the efficiency of heat transfer of the air conditioner is improved.

Second, since the operations of the plural compressors are properly controlled by the determined heating load in consideration of the outdoor temperature, the room temperature is properly maintained and the power consumption of the air conditioner is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a plurality of compressors for compressing a refrigerant;

an outdoor heat exchanger installed outdoors so as to be connected to the compressors, and so as to heat-exchange the refrigerant with outdoor air;

an indoor heat exchanger installed indoors so as to be connected to the outdoor heat exchanger, and so as to heat-exchange the refrigerant with indoor air;

a temperature sensor installed outdoors adjacent to the outdoor heat exchanger for sensing an outdoor temperature (T);

a comparison unit that compares the sensed outdoor temperature (T) to a predetermined temperature ($T_1$); and a controller that determines a magnitude of a heating load, and that operates all of the plural compressors when the outdoor temperature (T) is not higher than the predetermined temperature ($T_1$) or when the outdoor temperature (T) is higher than the predetermined temperature ($T_1$) and the heating load is equal to or larger than a predetermined value, and that operates fewer than all of the plural compressors when the outdoor temperature (T) is higher than the predetermined temperature ($T_1$) and the heating load is smaller than the predetermined value.

2. The air conditioner as set forth in claim 1, the comparison unit comprising a memory that stores the predetermined temperature ($T_1$).

3. The air conditioner as set forth in claim 1, wherein, the predetermined temperature ($T_1$) is in the range of 5° C. to 9° C., and heat is transferred from the refrigerant of the outdoor heat exchanger to outdoor air so as to effect a heat loss when the sensed outdoor temperature (T) is below the predetermined temperature ($T_1$).

4. The air conditioner as set forth in claim 1, wherein the controller determines the heating load using a difference between a room temperature and a desirable target temperature.

5. The air conditioner as set forth in claim 1, wherein the plurality of compressors include two compressors having different capacities.

6. An air conditioner comprising:

a plurality of compressors that compress a refrigerant;

an outdoor heat exchanger installed outdoors so as to be connected to the compressors, and so as to heat-exchange the refrigerant with outdoor air;

an indoor heat exchanger installed indoors so as to be connected to the outdoor heat exchanger, and so as to heat-exchange the refrigerant with indoor air;

a temperature sensor installed outdoors adjacent to the outdoor heat exchanger for sensing an outdoor temperature (T);

a comparison unit that compares the sensed outdoor temperature (T) to a predetermined temperature ($T_1$); and a controller that determines a heating load, and that operates one of fewer than all of the plural compressors and all of the plural compressors in accordance with both the determined heating load and the outdoor temperature;

wherein the plurality of compressors include two compressors having different capacities; and wherein, of the two compressors, the controller operates only one compressor having the relatively smaller capacity when the heating load is smaller than a predetermined value.

7. A method for controlling an air conditioner in a heating mode, comprising:

sensing an outdoor temperature (T) of the outdoors adjacent to an outdoor heat exchanger;

comparing the sensed outdoor temperature (T) to a predetermined temperature ($T_1$);

determining a magnitude of a heating load; and controlling a plurality of compressors of the air conditioner so that all of the plural compressors are operated when the outdoor temperature (T) is not higher than the predetermined temperature ($T_1$) or when the outdoor temperature (T) is higher than the predetermined temperature ($T_1$) and the heating load is equal to or larger than a predetermined value, and fewer than all of the plural compressors are operated when the outdoor temperature (T) is higher than the predetermined temperature ($T_1$) and the heating load is smaller than the predetermined value.

8. The method for controlling the air conditioner as set forth in claim 7, further comprising operating all of the plural compressors for a designated time at an initial stage of the heating mode.

9. The method for controlling the air conditioner as set forth in claim 7, wherein, the predetermined temperature ($T_1$) is in the range of 5° C. to 9° C., and heat is transferred from a refrigerant of the outdoor heat exchanger to the outdoor air when the sensed outdoor temperature (T) is not more than the predetermined threshold ($T_1$).

10. The method for controlling the air conditioner as set forth in claim 7, further comprising:

sensing a room temperature (t) and predetermining a target temperature ($t_0$); and after said controlling a plurality of compressors of the air conditioner, controlling said plurality of compressors of the air conditioner so that all of the plural compressors are operated when the room temperature (t) is lower than the target temperature ($t_0$), and all of the plural compressors are stopped when the room temperature (t) is equal to or higher than the target temperature ($t_0$).

11. A method for controlling an air conditioner in a heating mode, comprising:

sensing an outdoor temperature (T) of the outdoors adjacent to an outdoor heat exchanger;

comparing the sensed outdoor temperature (T) to a predetermined temperature ($T_1$);

determining a heating load; and controlling a plurality of compressors of the air conditioner so that one of fewer than all of the plural compressors and all of the plural compressors are operated based on both the determined heating load and the outdoor temperature (T);

wherein the determining a heating load includes comparing the difference between a room temperature and a desirable target temperature to a predetermined value;

wherein the plural compressors include two compressors having different capacities, and wherein, of the two compressors, the compressor having the relatively larger capacity of the two compressors is operated when the difference between the room temperature and the desirable target temperature is smaller than the predetermined value.

* * * * *

UNITED STATES PATENT AND TRADEMARK OFFICE

CERTIFICATE OF CORRECTION

PATENT NO. : 6,843,425 B2
DATED : January 18, 2005
INVENTOR(S) : W. H. Lee

It is certified that error appears in the above-identified patent and that said Letters Patent is hereby corrected as shown below:

Column 8,
Line 9, "for compressing" should be -- that compress --.

Signed and Sealed this

Thirtieth Day of August, 2005

JON W. DUDAS
*Director of the United States Patent and Trademark Office*